US010950971B2

(12) United States Patent
Lapierre

(10) Patent No.: US 10,950,971 B2
(45) Date of Patent: Mar. 16, 2021

(54) CIRCULAR CONNECTOR WITH SEALING GROMMET AND RETAINING RING

(71) Applicant: SAFRAN ELECTRICAL & POWER, Blagnac (FR)

(72) Inventor: Axel Lapierre, Blagnac (FR)

(73) Assignee: SAFRAN ELECTRICAL & POWER, Blagnac (FR)

( * ) Notice: Subject to any disclaimer, the term of this patent is extended or adjusted under 35 U.S.C. 154(b) by 0 days.

(21) Appl. No.: 16/609,366

(22) PCT Filed: Apr. 24, 2018

(86) PCT No.: PCT/FR2018/051020
§ 371 (c)(1),
(2) Date: Oct. 29, 2019

(87) PCT Pub. No.: WO2018/202978
PCT Pub. Date: Nov. 8, 2018

(65) Prior Publication Data

US 2020/0059037 A1 Feb. 20, 2020

(30) Foreign Application Priority Data

May 3, 2017 (FR) ..... 17 53891

(51) Int. Cl.
*H01R 13/52* (2006.01)
*H01R 13/443* (2006.01)
*H01R 13/59* (2006.01)
*H01R 107/00* (2006.01)

(52) U.S. Cl.
CPC ..... *H01R 13/5208* (2013.01); *H01R 13/443* (2013.01); *H01R 13/59* (2013.01); *H01R 2107/00* (2013.01)

(58) Field of Classification Search
CPC ... H01R 13/6473; H01R 12/716; H01R 31/06
See application file for complete search history.

(56) References Cited

U.S. PATENT DOCUMENTS 3,818,420 A * 6/1974 Barr ..... H01R 13/625 439/261
4,241,967 A 12/1980 Collins
(Continued)

FOREIGN PATENT DOCUMENTS

FR 2 464 577 A1 3/1981
GB 721872 A 1/1955
(Continued)

OTHER PUBLICATIONS

International Search Report dated Jun. 25, 2018 in PCT/FR2018/051020 filed on Apr. 24, 2018.
(Continued)

*Primary Examiner* — Abdullah A Riyami
*Assistant Examiner* — Nader J Alhawamdeh
(74) *Attorney, Agent, or Firm* — Oblon, McClelland, Maier & Neustadt, L.L.P.

(57) ABSTRACT

A circular electric connector including a socket extending along an axis and provided at an axial end with cavities, and a sealing grommet provided on the axial end defining a front face through which electric elements may be inserted in the cavities and a circumferential wall, the connector additionally including a housing wherein the socket is housed, the housing including an attachment device for attachment with a backshell, the connector including a retaining ring around the circumferential wall of the grommet, the retaining ring being adapted to limit the expansion of the diameter of the grommet when the electric elements are inserted through the grommet. A connection may be made with such a connector and a known or modified backshell.

10 Claims, 2 Drawing Sheets

(56) References Cited

U.S. PATENT DOCUMENTS

| | | | | |
|---|---|---|---|---|
| 8,075,477 | B2 * | 12/2011 | Nakamura | A61B 1/0011 600/132 |
| 9,118,138 | B2 * | 8/2015 | Bianca | H01R 13/424 |
| 9,368,903 | B1 | 6/2016 | Keep et al. | |
| 9,419,370 | B1 | 8/2016 | Keep et al. | |
| 9,450,338 | B2 * | 9/2016 | Reeves | H01R 13/631 |
| 2006/0068644 | A1 * | 3/2006 | Zauber | H01R 13/533 439/654 |
| 2007/0259568 | A1 * | 11/2007 | Mackillop | H01R 13/6471 439/638 |
| 2010/0015833 | A1 * | 1/2010 | Laughlin | H01R 13/5219 439/271 |
| 2014/0148019 | A1 * | 5/2014 | Sasaki | H01R 12/585 439/65 |
| 2014/0308846 | A1 * | 10/2014 | Bianca | H01R 13/4365 439/595 |
| 2018/0040986 | A1 * | 2/2018 | Tsang | H01R 13/652 |
| 2019/0074631 | A1 * | 3/2019 | Bowman | H01R 13/623 |
| 2020/0080417 | A1 * | 3/2020 | Pomerleau | E21B 47/06 |

FOREIGN PATENT DOCUMENTS

| | | | |
|---|---|---|---|
| GB | 2 050 714 | A | 1/1981 |
| WO | WO 2016/168038 | A1 | 10/2016 |

OTHER PUBLICATIONS

Preliminary French Search Report dated Jan. 8, 2018 in French Application No. 1753891 filed on May 3, 2017.

* cited by examiner

CIRCULAR CONNECTOR WITH SEALING GROMMET AND RETAINING RING

TECHNICAL FIELD

The present invention relates to a circular electrical connector with a sealing grommet. More particularly, the invention relates to a circular electrical connector with a sealing grommet that makes it possible to provide a sealed and secure connection in a reliable manner. The invention also relates to a connection with such a connector and a backshell.

PRIOR ART

In the field of aeronautics, manufacturing electrical harnesses often uses circular electrical connectors. These connectors allow the wires to be connected to each other in a tidy and rapid manner. A preferred type of circular connector is that which is compliant with the standard ASD-STAN, for example EN 3646 or EN 2997.

These connectors include a female portion with a socket. Typically, the socket is substantially cylindrical extending along a central axis and with an axial end provided with cavities extending towards the inside of the socket in the direction of the axis. The cavities each lead to an electrical contact, and are adapted to receive electrical elements, for example a wire or a pin connected to a wire, or the pins of a plug connected to the wires, etc. The socket is housed in a housing, extending in the direction of the socket and surrounding it. The housing, in particular the circumferential wall surrounding the socket, is provided with an attachment means, for example a thread on the circumferential wall.

The connector further comprises a sealing grommet, which is an elastomer layer attached to the axial end, provided on the cavities of the socket in order to ensure sealing of the connector. The grommet is also circular and of about the same diameter as that of the socket, comprising a front face, often further forward than the housing, and a circumferential wall. Its front face comprises holes that pass through the grommet and which lead to a respective cavity. The connector may be exposed to condensation when it is mounted in an aircraft, and the grommet with electrical elements, or stoppers when the electrical elements are not used, inserted through the grommet, prevent water or fluid from entering the cavities of the connector.

The electrical elements are generally provided with a backshell, that comprises a substantially tapered sleeve surrounding the electrical elements with a corresponding attachment means, such as a clamping nut with a thread rotatably mounted on the sleeve, for attaching to the connector. A preferred type of backshell is the one that is compliant with the standard AS85049. Once the electrical elements or the stoppers are inserted into the connector, the sleeve, which is frequently provided at its foremost portion with a chamfer in order to facilitate the passage thereof over the grommet and to lightly compress the grommet in the radial direction, is moved over the grommet towards the housing.

Next, the clamping nut is screwed on the thread of the housing of the connector. When the connection is made, the sleeve of the backshell is fully engaged (abutting against in this case, but can be nested) with the housing of the connector. In this state, the chamfer compresses the stoppers and electrical elements in the cavities in order to improve the seal of the grommet. This connector and backshell are known, shown in FIGS. 1A to 1C.

However, due to the insertion of the electrical elements or of the stoppers through the grommet, it sometimes undergoes an expansion in diameter and as a result the connector cannot guarantee a compliant assembly. More precisely, the chamfer of the sleeve catches on the grommet because of its enlarged diameter, sometimes aggravated by its material, and by the fact that the grommet is further forward than the housing, which prevents a full engagement between the sleeve of the backshell and the housing of the connector in the axial direction. With torque tightening of the clamping nut being able to reach the required value, the operator has the feeling of having correctly installed the connection.

This results in substantial stress on the grommet, which may be deformed, and with the incomplete engagement described hereinabove, is unable to fulfil its sealing function. Moreover, the housing, as well as the backshell, are sometimes made from a conductive material intended to provide a path for the electricity (accidental or grounding) and the incomplete engagement affects this path of electricity. In certain cases, the backshell does not even pass over the grommet because of the expansion. Consequently, a compliant connection is not obtained in terms of sealing, connection tightness and electrical conductivity.

To date, there is no reliable solution for attaching a backshell to a circular connector with a sealing grommet in a sealed and secure manner. Consequently, there remains a need for a circular connector with a grommet that can be attached to a backshell in a sealed and secure manner.

DISCLOSURE OF THE INVENTION

The present invention thus proposes a circular electrical connector comprising a socket extending along an axis and provided at an axial end with cavities, and a sealing grommet provided on the axial end defining a front face through which electrical elements can be inserted into the cavities and a circumferential wall, the connector additionally comprising a housing in which the socket is housed, the housing extending in the direction of the axis of the socket and surrounding it, the housing comprising an attachment means for attachment with a backshell, the connector comprising a retaining ring around the circumferential wall of the grommet, the ring being adapted to limit the expansion of the diameter of the grommet when the electrical elements are inserted through the grommet.

Preferably, the ring is of circular shape.

More preferably, the ring is of uniform thickness

Preferably, the ring is made from composite material.

Alternatively, the ring is made from stainless steel.

Advantageously, the surface of the outer wall of the ring is not as rough as the circumferential wall of the grommet.

Preferably, the foremost portion of the ring is at the same level as the front face of the grommet.

More preferably, the ring is adapted to prevent the expansion of the diameter of the grommet.

The present invention also proposes a connection comprising a connector such as the one defined hereinabove, and a backshell, the backshell comprising electrical elements, a sleeve surrounding the electrical elements, and an attachment means, wherein the electrical elements are inserted into the cavities of the socket, and the backshell and the connector are attached together by their attachment means.

Preferably, the backshell comprises a right angle at its foremost portion.

BRIEF DESCRIPTION OF THE DRAWINGS

The following describes, by way of non-limiting examples, embodiments of the invention, in reference to the accompanying drawings, wherein.

In all of these figures, identical references can designate identical or similar elements. Furthermore, the various portions shown in the figures are not necessarily shown on a uniform scale, in order to render the figures more legible.

DETAILED DISCLOSURE OF PARTICULAR EMBODIMENTS

Figure 1A:
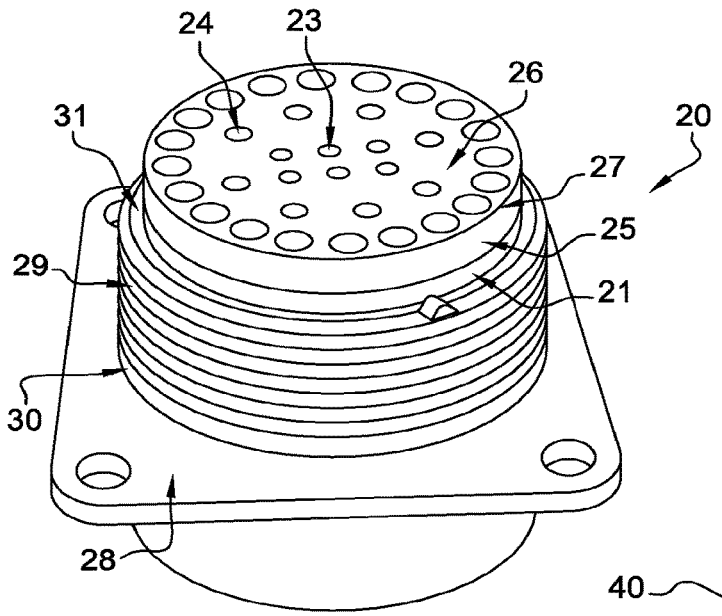
FIG. 1A shows a known connector.
Figure 1B:
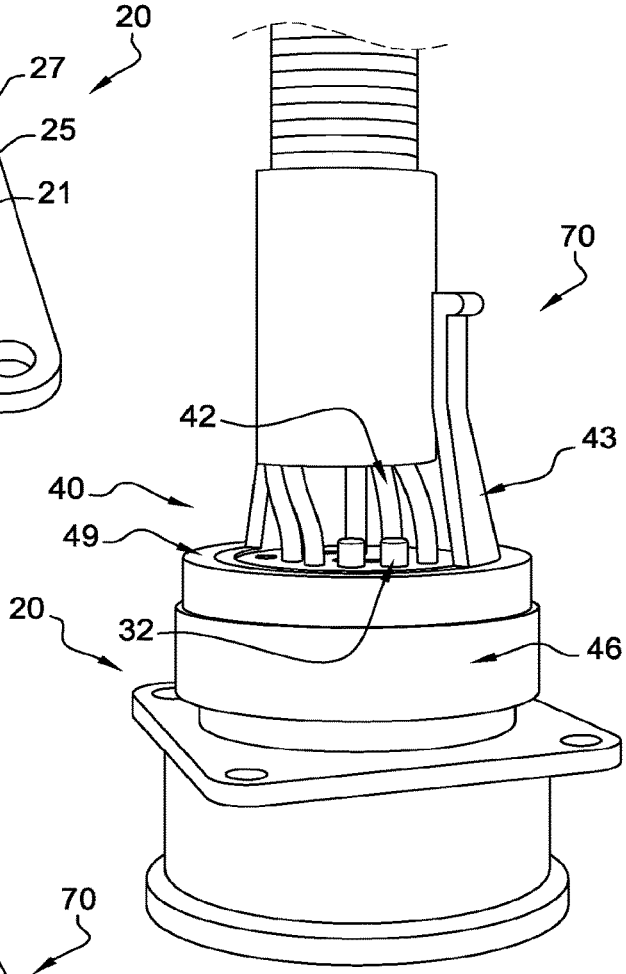
FIG. 1B shows a partial cross-section view of a connection comprising the connector of FIG. 1A and a known backshell.
Figure 1C:
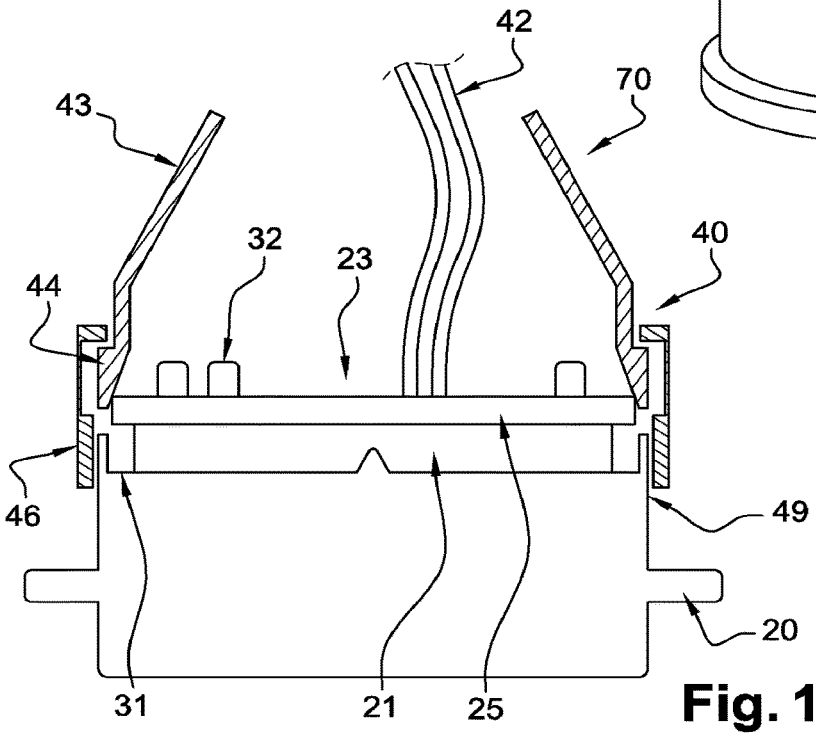
FIG. 1C shows a partial cross-section view of a portion of the connection of FIG. 1B.

FIG. 1A shows a known circular electrical connector 20 with a sealing grommet 25 (without electrical elements or stoppers inserted into its cavities). FIG. 1B shows a connection 70 comprising a known connector 20 and a known backshell 40. Electrical elements 42 of the backshell 40, which are individual wires 42 here, are inserted into the connector 20 and unused cavities 23 are able to have stoppers 32 inserted. Of course, the backshell 40 can comprise wires 42 linked to a plug with several pins instead of individual wires 42. FIG. 1C shows a partial cross-section view of a portion of the connection 70 of FIG. 1B, showing the case where the sleeve 43 of the backshell is caught on the grommet 25 due to the expansion of the grommet 25. As already described hereinabove, this connector 20 is not always capable of guaranteeing a sealed and secure connection.

Figure 2A:
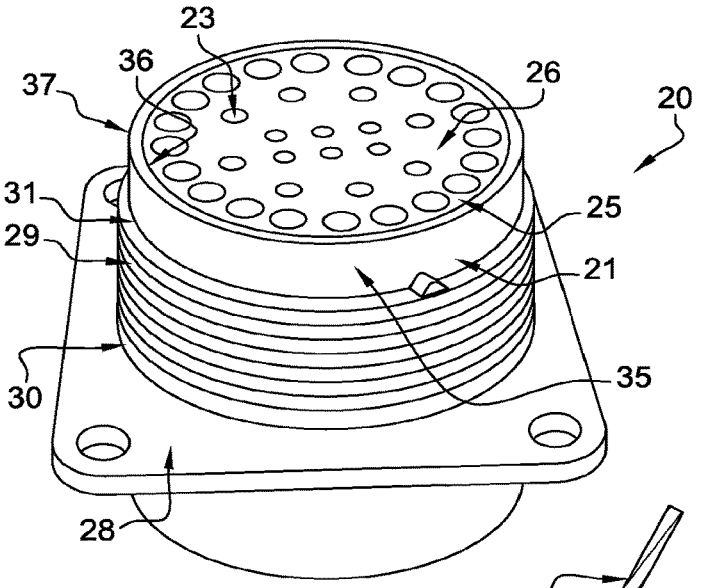
FIG. 2A shows a connector according to a preferred embodiment.

FIG. 2A shows a connector 20 according to a preferred embodiment. It is substantially the same as the connector 20 of FIGS. 1A to 1C, except for a grommet retaining ring 35.

The ring 35 is intended to limit the expansion of the grommet 25. It is provided around the grommet 25 on the socket 21 of the connector 20. More particularly, it is placed around the circumferential wall 27 of the grommet 25.

It is of circular shape, corresponding substantially to the shape of the grommet 25 which is also circular. The diameter of the inner wall 36 is the same as that of the circumferential wall 27 of the grommet 25. Of course, this diameter can be slightly smaller than that of the circumferential wall 27 of the grommet 25, for example in order to allow for a more secure engagement between the ring 35 and the grommet 25 (if the grommet 25 is made from a material that is flexible enough). Also, the inner diameter of the inner wall 36 of the ring 35 can be slightly larger than that of the grommet 25.

The ring 35 is rather thin in order to not take up much space in the radial direction. When the ring 35 is installed, it is designed such that the diameter of the grommet 25 and of the ring 35 combined together, without or with the electrical elements 42 and the stoppers 32, is less than that of the grommet 25 alone with the electrical elements 42 and/or the stoppers 32 inserted. The thickness of the ring 35 can vary along the circumference thereof, although uniform thickness is generally preferred. Here, its outer wall 37 is located in the middle of the outer diameter of the grommet (without electrical elements 42 or stoppers 32) and of the inner diameter of the foremost portion, typically the chamfer 44 of the sleeve 43, of the backshell 40 intended to be attached to the connector 20. The clearance facilitates the passage of the sleeve 43 over the socket 21 during the initial phase of engagement. Of course, as required, those skilled in the art can choose a thickness of the ring 35 that is different based on structural integrity and preferred clearance.

The ring 35 limits the expansion of the diameter of the grommet 25 when the electrical elements 42 or stoppers 32 are inserted into the connector 20. It is configured such that the diameter of its outer wall 37 does not change, or increases very little, when the electrical elements 42 are inserted into the connector 20. If it is of the type where the diameter of the outer wall 37 does not change, the expansion of the grommet diameter 25 is prevented (completely limited). Therefore, the ring does not allow the grommet 25 to exceed a certain diameter. By virtue of this, when the attachment means 46 of the backshell 40, i.e. the clamping nut 46 with the thread 49, are attached to the tightening means 29 of the connector 20, i.e. the thread 29 on the circumferential wall 30 of the housing 28, the grommet 25 no longer prevents the passage of the sleeve 43 and the complete engagement of the backshell 40 and the connector 20.

Figure 2B:
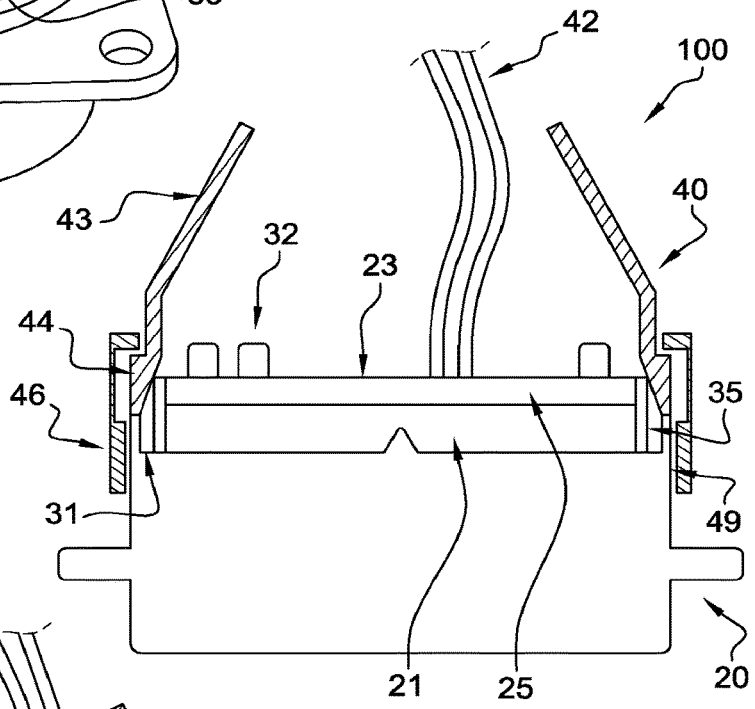
FIG. 2B shows a partial cross-section view of a connection comprising the connector of FIG. 2A and a known backshell.

As a result, a sealed and secure connection 100 is obtained such as shown in FIG. 2B. Although the ring 35 of the type wherein the diameter of the outer wall 37 does not change is preferred, the type wherein the diameter can increase a little can also be suitable. The important thing is that once the electrical elements 42 or stoppers 32 are inserted, the grommet 25 with the ring 35 do not hinder the subsequent connection with the backshell 40. The ring 35 can be of a height which is less than or greater than the thickness of the layer of the grommet 25. Preferably, the ring 35 is of a height which is at least equal to the thickness of the grommet 25, and provided on the grommet 25 such that it does not exceed the front face 26 of the grommet 25 when it is installed on the connector 20. Here, the foremost portion of the ring 35 is at the same level as the front face 26 of the grommet 25 in the direction of the axis of the socket 21.

The surface of the outer wall 37 of the ring 35 can be smooth or rough. A smooth surface can facilitate the advancing of the sleeve 43 over the ring 35, while a rough surface can facilitate the manipulation by hand during the installation. At the same time, the surface of the inner wall 36 of the ring 35 can be smooth or rough. A smooth surface can facilitate the installation of the ring 35 around the grommet 25, while a rough surface can assist in maintaining the ring 35 around the grommet 25 once installed. Preferably, the surface of the outer wall 37 of the ring 35 is not as rough as that of the grommet 25.

The retaining ring 35 is made from a material that resists expansion, which can be caused by the physical force or even the temperature, allowing it to limit or prevent the expansion of the grommet 25. Materials with structural resistance and resistance to high temperatures are preferred. Materials such as composites, for example a carbon fibre reinforced plastic, or metals, for example stainless steel, may be suitable. Preferably, the ring 35 is made of a single piece.

The mounting of the ring 35 is substantially the same for all of the connectors 20. The ring 35 is axially aligned with the socket 21 of the connector 20, and moved past the edge of the grommet 25. Then, it is lowered along the circumferential wall 27 of the grommet 25. If the connector 20 comprises a shoulder 31 towards the bottom of the grommet 25, for example, between the grommet 25 and the housing 28, or the socket 21 and the housing 28, the ring 35 may be lowered until this shoulder 31, so that it rests on the shoulder 31 while still remaining around, and in contact with, the grommet 25. In order to facilitate the mounting on the grommet 25, a chamfer can be provided on the ring 35.

The ring 35 can be mounted on the socket 21 of the connector 20 during the manufacture or immediately before the installation of the connector 20 in a harness. Furthermore, the ring 35 can also be retrofitted to connectors 20 in existing connections 70.

Of course, certain features of the ring 35 can be modified by those skilled in the art based on the type of connector, use, temperature, tightening torque required, etc. In an alternative, the ring 35 can be of a slightly elliptical shape, for example in order to correspond with a grommet 25 of a slightly elliptical connector. Note that the sealing grommet 25 is shown with the holes 24 leading to the cavities 23 of the socket 21. These can be holes that close up on their own, for example without the electrical elements. It can also be of the type wherein the holes are formed when the electrical elements are inserted into it for the first time.

The attachment means can also be different, for example, instead of the clamping nut 46 with thread 49, the backshell 40 can comprise threads on the sleeve, while instead of the thread 29 on the circumferential wall 30 of the housing, the connector 20 can include a clamping nut with thread. Moreover, instead of the thread 29, 49, the attachment means between the connector and the backshell may have a bayonet system.

Figure 2C:
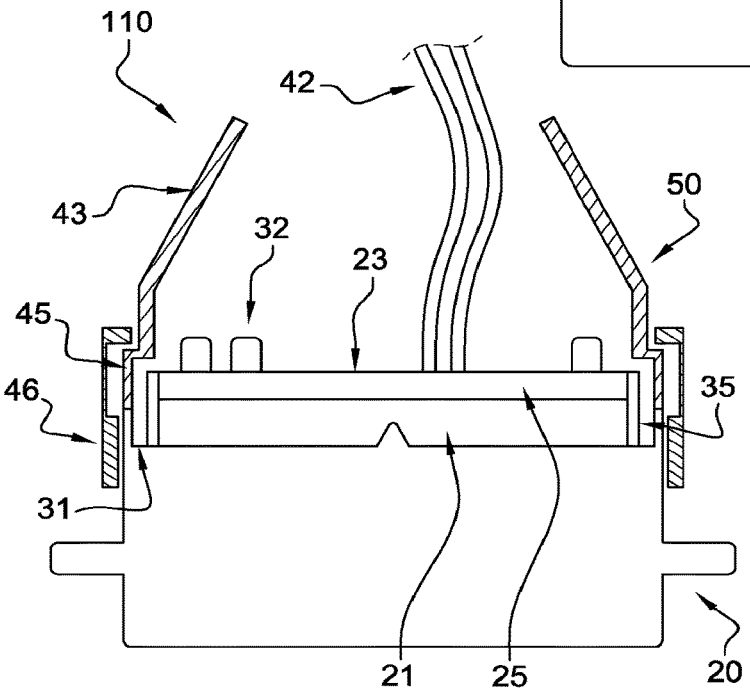
FIG. 2C shows a connection similar to the one of FIG. 2B, with a modified backshell.

Instead of a backshell 40 with a chamfer 44, a modified backshell 50 with a right angle 45 at the foremost portion of the sleeve 43 can also be used. Inserting electrical elements 42 and stoppers 32 when the ring 35 is installed by itself compresses the grommet 25 and improves the sealing thereof. Consequently, the chamfer 44 no longer needs to be designed to compress the grommet 25. FIG. 2C shows a connection 110 with such a backshell 50, with the right angle 45 not touching the ring 35, with its inner diameter being larger than the outer diameter of the ring 35.

Until now, adjusting the chamfer 44 was the main approach taken by backshell manufacturers. However, this solution does not make it possible to resolve the problem for each insertion configuration as the expansion of the diameter of the grommet 25 is not always the same and depends for example, on the proportion of the electrical elements 42 and of the stoppers 32, their dimensions, etc. As such, the connection quality is inconsistent.

The solution proposed by the invention is advantageous. With the ring 35 installed around the grommet 25, the expansion of the grommet 25 is limited, or prevented, and therefore the clearance between the backshell 40, 50 and the ring 35 remains substantially the same. Consequently, the backshell 40, 50 always manages to engage completely with the connector 20 and to be attached together. Moreover, the fact that the outer diameter of the ring 35, i.e. the diameter of the outer wall 37, remains substantially the same when the electrical elements 42 or stoppers 32 are inserted, implies that the backshell 40, 50 comes into contact with the ring 35 always at the same point, or not at all, with this feature providing a consistency in terms of the reliability of the connection 100, 110 and of the quality of the sealing.

Of course, the fact that the connector 20 is adapted to receive the electrical elements 42 in the cavities 23 does not prevent it from receiving other elements, for example stoppers 32, which is also within the scope of the invention. Also, the fact that the ring 35 is adapted to limit or prevent the expansion of the diameter of the grommet 25 when the electrical elements 42 are inserted in through the grommet 25 does not prevent it from limiting or preventing the expansion of the diameter of the grommet 25 when other elements are inserted, for example stoppers 32. Furthermore, although the embodiments are described in relation to specific connectors and backshells, those skilled in the art realise that the invention is suitable for connectors of other types with the same problem of expansion of the grommet.

The invention claimed is:

1. A circular electrical connector comprising a socket extending along an axis and provided at an axial end with cavities, and a sealing grommet provided on the axial end defining a front face through which electrical elements can be inserted into the cavities and a circumferential wall, the connector additionally comprising a housing wherein the socket is housed, the housing extending in the direction of the axis of the socket and surrounding the socket, the housing comprising an attachment means for attachment with a backshell, wherein the connector comprises a retaining ring around the circumferential wall of the grommet, the ring being adapted to limit the expansion of the diameter of the grommet when the electrical elements are inserted through the grommet.

2. The connector according to claim 1, wherein the ring is of circular shape.

3. The connector according to claim 1, wherein the ring is of uniform thickness.

4. The connector according to claim 1, wherein the ring is made from composite material.

5. The connector according to claim 1, wherein the ring is made from stainless steel.

6. The connector according to claim 1, wherein the surface of the outer wall of the ring is not as rough as the circumferential wall of the grommet.

7. The connector according to claim 1, wherein the foremost portion of the ring is at the same level as the front face of the grommet.

8. The connector according to claim 1, wherein the ring is adapted to prevent the expansion of the diameter of the grommet.

9. A connection comprising the connector according to claim 1, and the backshell, the backshell comprising the electrical elements, a sleeve surrounding the electrical elements, and an attachment means, wherein the electrical elements are inserted into the cavities of the socket, and the backshell and the connector are attached together by their attachment means.

10. The connection according to claim 9, wherein the backshell comprises a right angle at the foremost portion of the sleeve.

* * * * *